US006500111B1

(12) United States Patent
Salmon et al.

(10) Patent No.: US 6,500,111 B1
(45) Date of Patent: Dec. 31, 2002

(54) INFANT CARE ENCLOSURE

(75) Inventors: Andrew Paul Maxwell Salmon, Auckland (NZ); Mladen Smolcic, Auckland (NZ)

(73) Assignee: Fisher & Paykel Limited, Auckland (NZ)

( * ) Notice: Subject to any disclaimer, the term of this patent is extended or adjusted under 35 U.S.C. 154(b) by 0 days.

(21) Appl. No.: 09/439,824

(22) Filed: Nov. 12, 1999

(30) Foreign Application Priority Data

Nov. 13, 1998 (NZ) ..... 332797

(51) Int. Cl.[7] ..... A61G 11/00
(52) U.S. Cl. ..... 600/22
(58) Field of Search ..... 600/21–22; 312/3; 5/97

(56) References Cited

U.S. PATENT DOCUMENTS

| | | | | | |
|---|---|---|---|---|---|
| 3,272,199 | A | * | 9/1966 | Matthews | 600/21 |
| 3,782,362 | A | * | 1/1974 | Puzio | 128/205.26 |
| 3,818,896 | A | * | 6/1974 | Deaton | 600/22 |
| 3,878,570 | A | * | 4/1975 | Donnelly | 600/22 X |
| 3,898,427 | A | * | 8/1975 | Levin et al. | 600/22 X |
| 4,000,749 | A | * | 1/1977 | Busco | 600/21 |
| 4,026,286 | A | * | 5/1977 | Trexler | 600/22 X |
| 4,121,571 | A | | 10/1978 | Pickering | |
| 4,161,172 | A | | 7/1979 | Pickering | |
| 4,750,474 | A | * | 6/1988 | Dukhan et al. | 128/205.26 |
| 4,846,783 | A | * | 7/1989 | Koch et al. | 600/22 |
| 4,885,000 | A | * | 12/1989 | Hogan | 600/21 |
| 5,342,121 | A | * | 8/1994 | Koria | 600/21 X |
| 5,385,529 | A | * | 1/1995 | Koch | 600/22 |
| 5,387,177 | A | * | 2/1995 | Dunn | 600/22 |
| 5,445,143 | A | | 8/1995 | Sims | |
| 5,498,229 | A | | 3/1996 | Barsky et al. | |
| 5,649,896 | A | | 7/1997 | Barsky | |
| 5,707,337 | A | * | 1/1998 | Franz | 219/400 |
| 5,759,149 | A | * | 6/1998 | Goldberg et al. | 600/22 |
| 5,817,003 | A | * | 10/1998 | Moll et al. | 600/22 |
| 5,878,190 | A | * | 3/1999 | Gloyd et al. | 392/403 |
| 5,935,055 | A | * | 8/1999 | Koch et al. | 600/21 |
| 6,210,320 | B1 | * | 4/2001 | Rogone et al. | 600/22 |

FOREIGN PATENT DOCUMENTS

| | | |
|---|---|---|
| EP | 753983 | 1/1997 |
| WO | WO 97/43995 | * 11/1997 |

* cited by examiner

*Primary Examiner*—Max F. Hindenburg
*Assistant Examiner*—Joseph A. Cadugan
(74) *Attorney, Agent, or Firm*—Trexler, Bushnell, Giangiorgi, Blackstone & Marr, Ltd.

(57) ABSTRACT

The present invention provides an enclosed humidified environment for an infant positioned on the mattress of an infant warmer open care bed. It includes an "A" frame structure which supports a flexible and transparent cover similar to a tent, which may be folded substantially flat when not in use or prior to use. The tent is designed to be compatible with an infra-red radiant heater, such as might be used in a infant warmer open care bed to heat the infant. The tent includes provisions for inflow of humidified gases and accessibility to the infant by health care workers. In addition, the present invention may be provided as a disposable item thereby reducing the possibility of transferring medical problems between infants.

14 Claims, 5 Drawing Sheets

INFANT CARE ENCLOSURE

BACKGROUND OF THE INVENTION

1. Field of Invention

This invention relates to apparatus for providing an infant care enclosure and more particularly, though not solely to apparatus for providing a enclosed humidified environment to an infant positioned on the mattress of an infant warmer open care bed.

2. Description of the Prior Art

The advantages of an open care bed, such as an infant warmer, over an incubator are well known The ability of health care specialists to obtain easy, unhindered access to the infant while providing the infant with a stable temperature environment. The problem of Insensible Water Loss (ISW) whereby a very young infant's skin easily loses water to the ambient surroundings is also well known and it would be beneficial if the infant could be treated from a bed which combined the convenience of an infant warmer with the ability to maintain a substantially constant level of humidity.

One prior attempt to overcome the above disadvantages is disclosed in United States patent numbers U.S. Pat. No. 649,896 and U.S. Pat. No. 5,498,229 issued to Air-Shields Inc. This patent discloses an infant warmer which also includes a roll of disposable PVC film which is rolled out to cover the open side of the infant warmer's bassinet In order to treat the infant it is necessary to remove the film and to reapply a further length over the infant when treatment is completed. A further example is disclosed in United States patent numbers U. S. Pat. No. 4,121,571 and U.S. Pat. No. 4,161,172 issued to Airborne Life Support Systems Inc. wherein an infant is positioned within a flexible plastics tubular membrane inside a clear, rigid box-like outer enclosure. A humidified gases flow may be passed through the inner flexible tubular membrane and the outer enclosure may be positioned beneath a radiant heat source. This device does not allow adequate or effective access to the infant, especially in emergencies.

An infant "heatshield" construction has been sold under the trade mark IGLOO by Nascor (Pty) Limited of Australia. This device comprises a tough polycarbonate half-cylinder having two detachable soft silicon end caps for access to an infant within However, it is believed that this device is not suitable for use with an overhead heat source such as that of an infant warmer as polycarbonate does not transmit infra-red energy efficiently and is not disposable. Furthermore, this device is not able to be packaged in a collapsible form and therefore takes up excessive space during transportation.

SUMMARY OF THE INVENTION

It is, therefore, an object of the present invention to provide a humidified environment which will go at least some way towards overcoming the above disadvantages or which will at least provide the industry with a useful choice.

Accordingly, in one aspect, the invention consists in an infant care enclosure comprising:

a frame which in use is positioned on a surface, a flexible cover substantially covering said frame except for the portion of said frame in contact with said surface and adapted to be supported by said frame thereby, and in conjunction with said surface, providing an enclosed space suitable for enclosing an infant, said flexible cover being substantially transparent to infra-red light, said frame having at least one user access port formed therein which is substantially covered by a section of said flexible cover which is larger than the area of said at least one user access port

BRIEF DESCRIPTION OF THE DRAWINGS

One preferred form of the present invention will now be described with reference to the accompanying drawings in which.

DETAILED DESCRIPTION OF THE PREFERRED EMBODIMENTS

Figure 1:
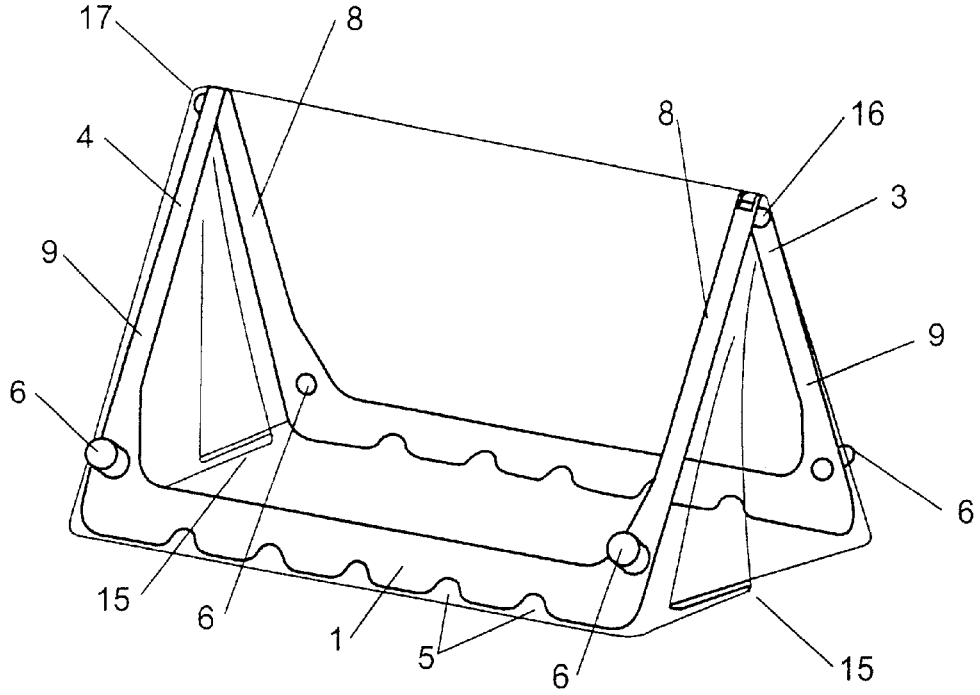
FIG. 1 is a perspective view of a humidity tent according to the preferred embodiment of the present invention.

With reference to the drawings and in particular FIG. 1, a humidity tent is shown which is suitable for providing a substantially closed environment within while still allowing relatively easy access from outside. The humidity tent is suitable for uses such as in providing a substantially closed environment for an infant or newborn baby and could, for example, be positioned upon the bassinet of an infant warmer (such as the infant Warmer described in EP753983), beneath an infra-red heat source so that an infant could benefit from the heat provided by the warmer while also enjoying a stable ambient environment and remaining easily accessible to health care staff.

Figure 2:
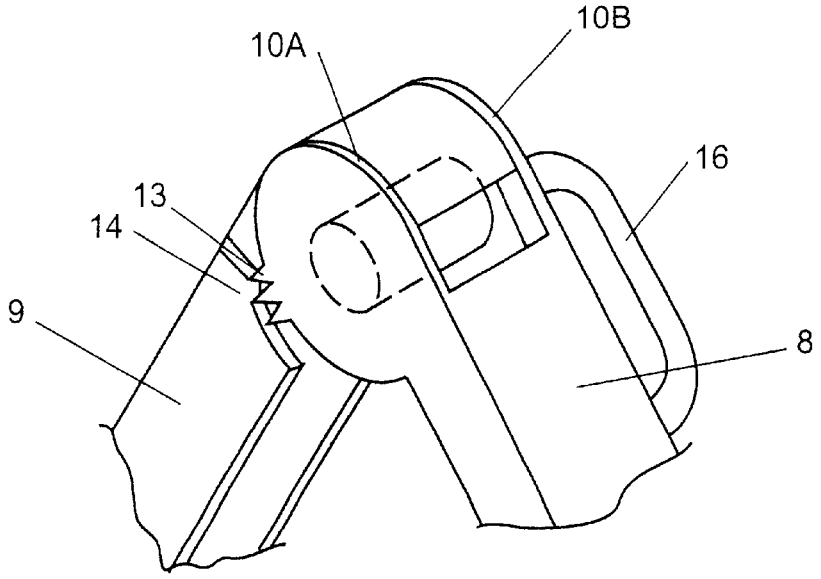
FIG. 2 is a close up perspective view of one of the hinges of the humidity tent shown in FIG. 1.
Figure 3:
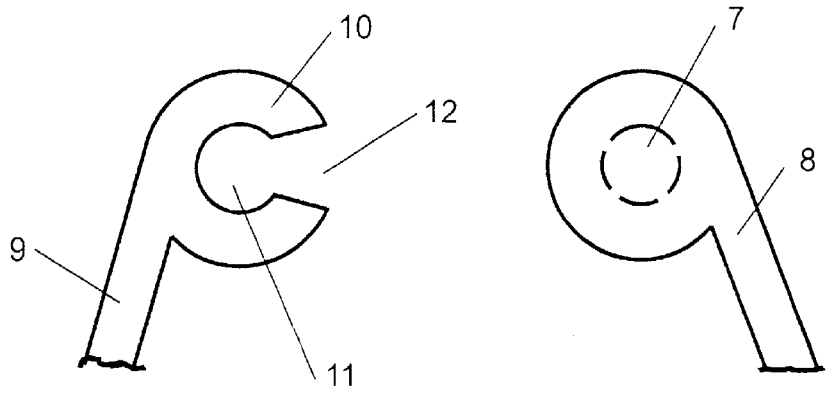
FIG. 3 is a side elevation view of the side members of the frame of the humidity tent shown in FIG. 1 prior to connection.
Figure 4:
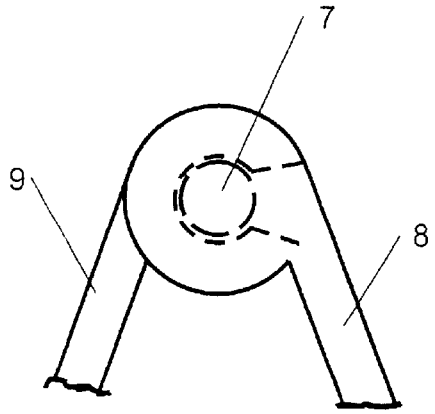
FIG. 4 is a side elevation view of the side members of the frame of the humidity tent shown in Figure after connection.
Figure 5:
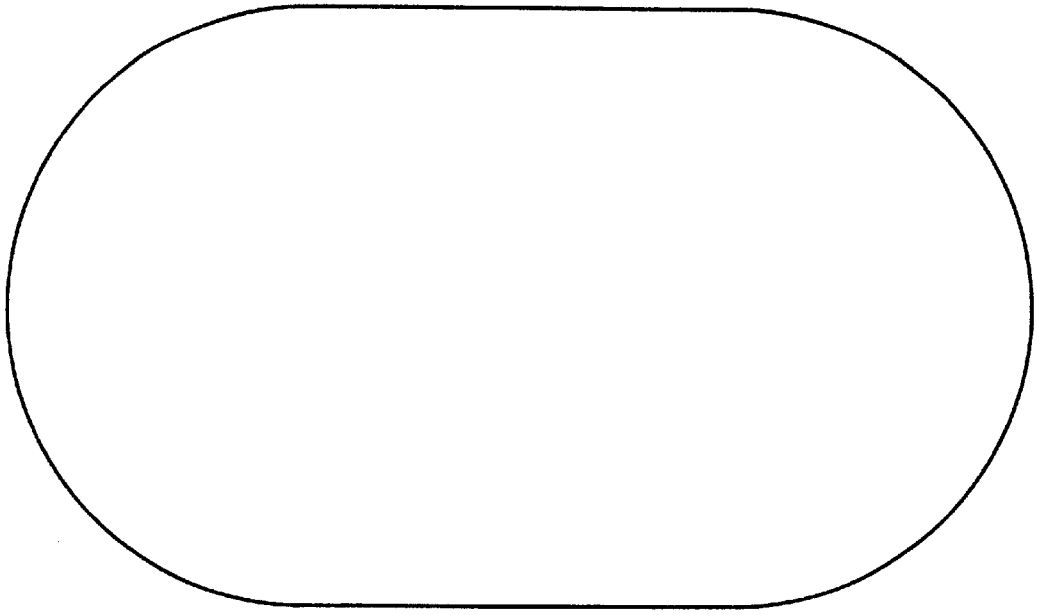
FIG. 5 is a top plan veiw of a streteched hexagon sheet of material wherein the lengths of two parallel sides are lognger than the lengths of the other four sides used in the humidity tent prior to attachment to a frame of the humidity tent.
Figure 6:
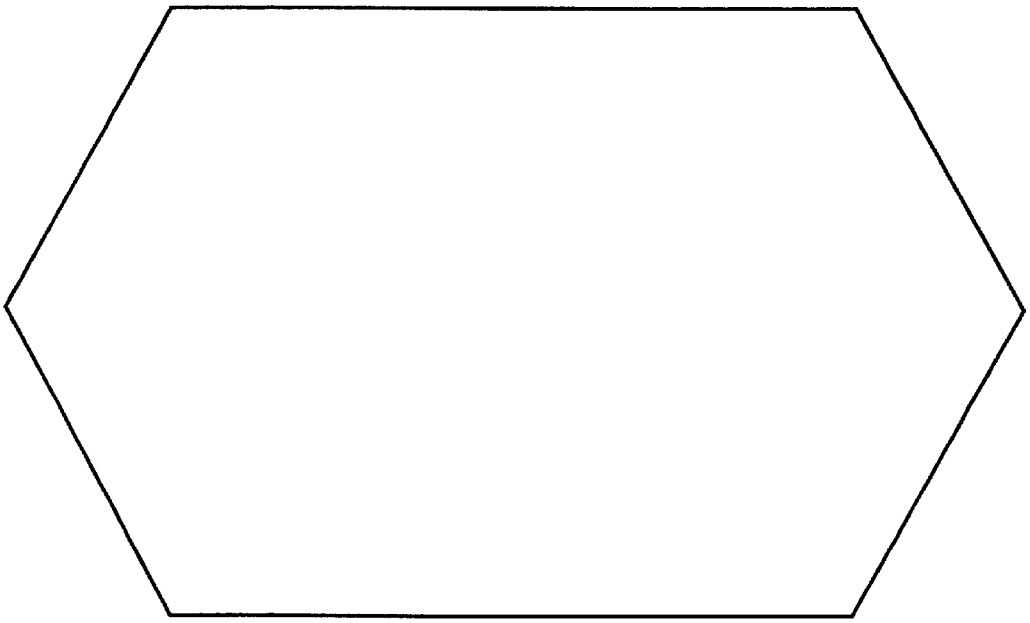
FIG. 6 is a top plan view an obround shaped sheet of material used in the humidity tent prior to attachment to a frame of the humidity tent.
Figure 7:
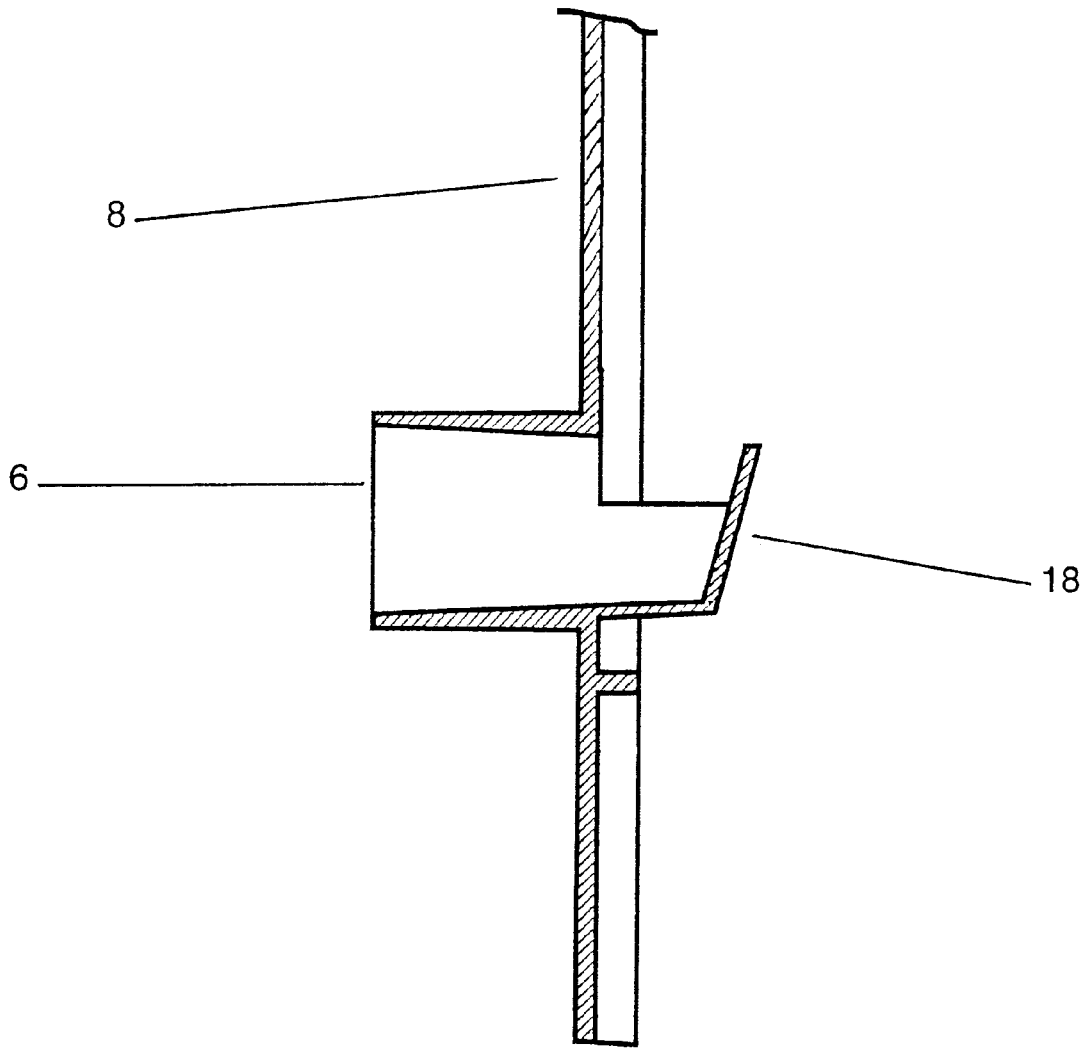
FIG. 7 is a cross-sectional view of the frame through the inlet port showing one of the baffles.
Figure 8:
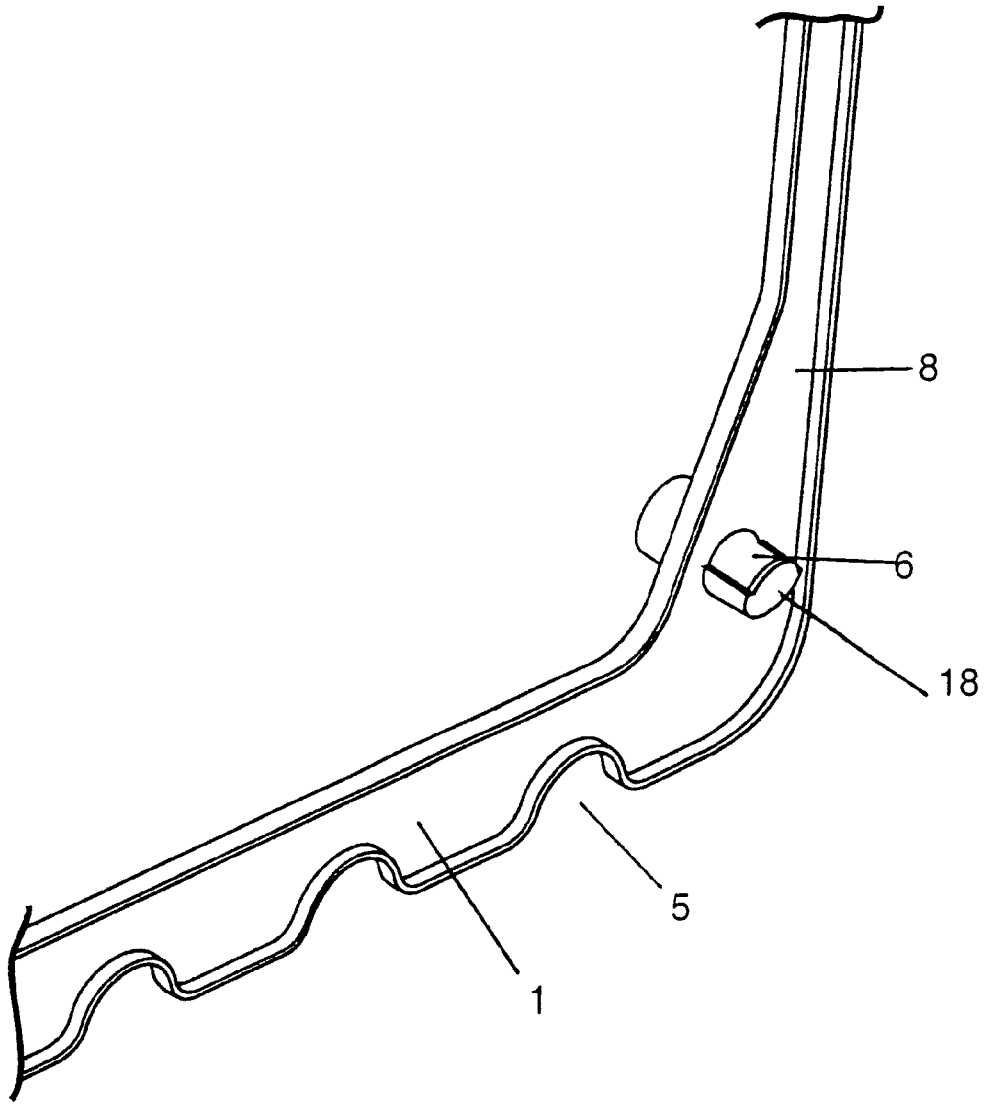
FIG. 8 is a perspective view of the frame showing on of the baffles.

The humidity tent has a frame 1 and a flexible covering 2. Preferably the frame 1 is moulded or otherwise produced from a stiff plastics material such as high density polyethylene and the flexible covering 2 is manufactured from a lightweight, substantially transparent plastics material such as low density polyethylene film with a thickness preferably in the range of 5 $\mu$m to 30 $\mu$m. Preferably the flexible covering 2 is substantially transparent to visible light in order that the infant within the humidity tent may be easily visually monitored by medical staff while also being substantially transparent to light in the infra-red section of the specimen in order that heat from an overhead infra-red heat source may be transmitted through to the infant. Of course if an alternative heat source were used which produces energy at another characteristic wavelength, then the flexible covering should be designed to allow transmission of that particular wavelength It can be seen from FIG. 1 that the frame 1 of the humidity tent is preferably a two-part construction with a first frame member 3 and a second frame member 4. In the preferred form of the invention the frame members 3 and 4 are of a substantially "U" shaped construction with two parallel side members 8, 9 joined by a base member substantially perpendicular to both side members. The base members of each frame member are provided with a number (for example five) recesses or grooves 5. Each of the frame members are also provided with gases inlet ports 6 which are adapted to be connected to receive humidified gases such as those leaving a respiratory humidifier (for example a humidifier as described U.S. Pat. No. 5,445,143). As shown in FIGS. 7 and 8, each of the inlet gases ports 6 may also be provided with baffles 18 comprising an angled rigid surface upon which the incoming gases flow is diverted. Preferably the angle of the baffle 18 is arranged such that incoming gases are directed upward and in towards the centre of the humidity tent. mechanisms are provided. With reference in particular to FIGS. 2, 3 and 4, preferably the hinge mechanism comprises a captive pin 7 which is held captive within the end of a first side member 8 and a substantially "C" shaped receptacle 10 at the end of a second side member 9. The substantially "C" shaped receptacle 10 has a circular slot 11 having a diameter slightly larger th the diameter of pin 7 and an entrance slot 12 which is slightly smaller than the diameter of pin 7. Preferably, the substantially "C" shaped receptacle 10 comprises a pair of substantially "C" shaped receptacles 10A and 10B. Accordingly, once the pin 7 has been pushed through entrance slot 12 it will sit securely within slot (or slots in the case of a pair of receptacles) 11 allowing side member 9 to rotate about pin 7.

In order to adjustably fix the angle between the two side members 8 and 9, a number of detents 13 are provided on the outer surface of member 8 with a complimentary protrusion 14 provided on a surface of member 9. Accordingly, rotation of the side members will be possible although there are a number of "stable" positions in which the angle between the side members will be fixed. Alternatively a strap (not shown) or other similar device could be attached between the two side members which would allow the members to pivot apart and then be fixed at a preset angle. Preferably hooks 16 and 17 are provided at or near the ends of one of the side members 8 or 9 to allow the humidity tent to be hung (when not in use) from a hook provided, preferably, in a suitable position such as on the side or rear of an infant warmer.

The flexible covering 2 is preferably welded, glued or otherwise affixed to the frame either before or after the two frame members have been connected. Preferably the flexible covering is affixed to the frame after the frame members are connected or alternatively the humidity tent could be sold in "kit set" form as three separate pieces (two frame members and flexible covering 2) with additional material supplied which may be used to attach the flexible covering to the fame once the user has connected the two frame members together. For example, the edges of the flexible covering 2 could be provided with adhesive surfaces beneath removable covers (similar to the way in which some courier envelopes are provided with adhesive seals beneath a removable cover). Flexible covering 2 preferably comprises a plastics sheet which is shaped in such a way so as to produce a pleat or "gather" 15 at either end opening of the frame. The excess plastics sheet material in pleat 15 enables a health care worker's arm to be inserted underneath the flexible covering while also retaining a partial "seal" around the worker's arm. Accordingly, the temperature and humidity of the environment within the humidity tent will be minimally effected when a health care worker is treating the infant.

Preferably the shape of the flexible covering 2 is a stretched hexagonal shape whereby two of the six parallel sides are longer than the other four sides. The two longer sides are substantially the same length as the base members while the other sides are substantially the same length as side members 8 and 9. The longer two sides would then be attached to the base members and accordingly the distance between these two parallel longer sides must be about or slightly more than two times the length of one side member 8 or 9. Preferably the length of the base members are about 450 mm and the height of the side members 8 and 9 is about 300 mm.

Alternatively the flexible covering 2 could be produced in a "racing track" shape (comprising either two half circles or two half ellipses capping the shorter opposite sides of a central rectangle). It will also be appreciated that many other configurations, such as zips, flaps etc. will be equally applicable, that will allow access to the infant without substantial disruption to the environment within.

In use, the base members of each of frame members 3 and 4 are adapted to be positioned onto a substantially smooth and horizontal s e, such as the bassinet mattress of an infant warmer. As previously mentioned, the angle between the two side members 8 and 9 may be adjusted as desired by the user. The flexible covering 2 is draped from the frame and falls in such a way that pleats or "gathers" 15 are produced at the end openings of the frame.

A conduit supplying humidified gases may be connected to any one of inlet ports 6 and the other ports plugged by a suitable cap or stopper. Preferably the humidifier will provide humidified gases to the infant at a rate of about 5 to 10 liters per minute. Any tubes, IV lines, electrode leads, catheter drain lines or the like which must be connected to the infant may be passed through to the infant via the recesses or grooves 5 in the base members.

Accordingly, at least in the preferred form of the present invention, a humidity tent is provided which may be folded substantially flat when not in use or prior to use. In addition, the present invention may be provided as a disposable item thereby reducing the possibility of transferring medical problems between infants. Furthermore, the present humidity tent is of a simple yet reliable construction and provides a substantially enclosed space which may be easily humidified while maintaining accessibility to the infant by health care workers.

We claim:

1. An infant care enclosure comprising:

a frame which in use is positioned on a surface, said surface adapted to support an infant, a flexible cover substantially covering said frame except for the portion of said frame in contact with said surface and adapted to be supported by said frame thereby, and in conjunction with said surface, providing an enclosed space suitable for enclosing an infant, said flexible cover being substantially transparent to infra-red radiation, said frame having at least one user access port formed therein which is substantially covered by a section of said flexible cover which is larger than the area of said at least one user access port, at least one gases port formed in said frame and configured to direct gases generally upwardly into said enclosed space.

2. An infant care enclosure as claimed in claim 1 wherein said frame forms a substantially "A" framed support structure.

3. An infant care enclosure as claimed in claim 2 wherein said frame comprises two substantially "U" shaped frame members each having two substantially parallel legs members joined at one end hereof to a base member being perpendicular thereto, the two frame members connected together by a pivotal attachment of the free ends of their respective leg members producing an angle therebetween.

4. An infant care enclosure as claimed in claim 3 wherein said pivotal connection between said frame members includes a stopper to allow fixed adjustment of the angle between said frame members.

5. An infant care enclosure as claimed in claim 4 wherein said base member of said frame includes at least one recess such that a passage is formed between said surface and said base member of said frame which in use allows tubes to pass into said enclosed space.

6. An infant care enclosure as claimed in claims 1 or 2 wherein said flexible cover is bonded to at least one of said frame members.

7. An infant care enclosure as claimed in claims 1 or 2 wherein said flexible cover comprises a low density polyethylene film of between about 5 $\mu$m and about 30 $\mu$m thickness.

8. An infant care enclosure as claimed in claims 1 or 2 wherein said flexible cover comprises an obround shaped sheet of material.

9. An infant care enclosure as claimed in claims 1 or 2 wherein said flexible cover comprises a stretched hexagon wherein the lengths of two parallel sides are longer than the lengths of the other four sides.

10. An infant care enclosure as claimed in claims 1 or 2 wherein said infant care enclosure is adapted to be positioned beneath an infra-red light source to heat said infant.

11. An infant care enclosure as claimed in claims 1 or 2 wherein said infant care enclosure is adapted to be positioned upon the bassinet of an infant warmer open care bed.

12. An infant care enclosure as claimed in any one of claims 1 to 5 wherein said gases port located in a portion of said frame in use adjacent a surface and is configured to direct humidified gases in a substantially upward direction.

13. An infant care enclosure as claimed in claim 12 wherein said at least one gases port is provided with a deflector to direct the gases travelling into said enclosed space upwards and towards the centre of said enclosed space.

14. An infant care enclosure as claimed in claim 12 wherein said at least one gases port is connected to receive humidified gases at the rate of between about 5 to about 10 liters per minute.

* * * * *

UNITED STATES PATENT AND TRADEMARK OFFICE

CERTIFICATE OF CORRECTION

PATENT NO. : 6,500,111 B1 
DATED : December 31, 2002
INVENTOR(S) : Andrew Paul Maxwell Salmon and Mladen Smolcic It is certified that error appears in the above-identified patent and that said Letters Patent is hereby corrected as shown below:

Column 2,
Lines 20-21, “lognger” should be -- longer --

Column 3,
Line 15, “mechanisms are provided” should be -- In order for the two frame members 3 and 4 to be connected, two hinge mechanisms are provided --

Column 4,
Line 20, “horizontal s e,” should be -- horizontal surface, --

Signed and Sealed this

Twenty-eighth Day of October, 2003

JAMES E. ROGAN
*Director of the United States Patent and Trademark Office*